US005156028A

United States Patent [19]

Jiang

[11] Patent Number: 5,156,028

[45] Date of Patent: Oct. 20, 1992

[54] PADLOCK HAVING A CABLE SHACKLE AND A LOCKING MEANS BASED ON COMBINATION OF NUMERALS

[76] Inventor: Jy-Chang Jiang, No. 14, Sec. 1, Shin Ren Rd., Tay Pyng Shi, Taichung Shiann, Taiwan

[21] Appl. No.: 681,605

[22] Filed: Apr. 8, 1991

[51] Int. Cl.[5] ..... E05B 37/06

[52] U.S. Cl. ..... 70/30; 70/18; 70/233

[58] Field of Search ..... 70/14, 18, 20–22, 70/30, 49, 233

[56] References Cited

U.S. PATENT DOCUMENTS

| | | | |
|---|---|---|---|
| 3,906,758 | 9/1975 | Huewitt | 70/30 |
| 4,033,160 | 7/1977 | Mima | 70/49 X |
| 4,037,441 | 7/1977 | Ray | 70/49 X |
| 4,044,577 | 8/1977 | Horlacher | 70/49 X |
| 4,086,795 | 5/1978 | Foster et al. | 70/49 X |
| 4,354,365 | 10/1982 | Mayer et al. | 70/30 |
| 4,543,806 | 10/1985 | Papandrea et al. | 70/30 |
| 4,610,152 | 9/1986 | Duringer | 70/30 |
| 4,665,724 | 5/1987 | Sakai | 70/30 |
| 4,756,171 | 7/1988 | Homar | 70/30 X |
| 4,896,517 | 1/1990 | Ling | 70/30 X |

*Primary Examiner*—Renee S. Leubke
*Assistant Examiner*—Suzanne L. Dino
*Attorney, Agent, or Firm*—Browdy and Neimark

[57] ABSTRACT

A wire lock includes a push-button latch operatively locking a locking head of a wire rope wound in a lock casing, and operatively depressed for disengaging the locking head of the wire rope when opening the lock so that the wire rope can be automatically retracted into the lock casing. The locking head of the wire rope may be depressed to disengage a plurality of sleeves from dials of the wire lock for conveniently resetting a new combination for the lock.

3 Claims, 5 Drawing Sheets

PADLOCK HAVING A CABLE SHACKLE AND A LOCKING MEANS BASED ON COMBINATION OF NUMERALS

BACKGROUND OF THE INVENTION

The present invention relates to a padlock, and more particularly to a multi-purpose padlock having a cable shackle and a locking means based on combination of numerals.

The conventional padlock of prior art comprises a cable shackle of a fixed length whose release end can not be actuated by a locking mechanism controlling a locking means based on combination of numerals.

SUMMARY OF THE INVENTION

It is, therefore, the primary objective of the present invention to provide a padlock comprising a locking mechanism capable of actuating the release end of the cable shackle thereof and a locking means which is based on combination of numerals and is designed in such a manner that it facilitates the change in an unlocking combination.

It is another objective of the present invention to provide a padlock with a cable shackle capable of winding extensibly, locking to orient itself, and rewinding automatically.

In keeping with the principles of the present invention, the primary objectives of the present invention are accomplished by a padlock having a cable shackle and a locking means based on combination of numerals. The padlock comprises a locking mechanism controlling the locking and unlocking operations of the release end of the cable shackle of the padlock and a combination assembly which is based on combination of numerals to control the locking and the unlocking operations of the locking mechanism. The control mechanism of the cable shackle is composed of a rotating wheel with a cable shackle winding thereon. The release end of the cable shackle can be pulled out along a tangential direction of the rotating wheel. A volute spring is provided to facilitate the rotating wheel to gyrate automatically. In addition, a braking means is provided to position the rotating wheel. The combination assembly includes several numerical pieces capable of selectively adjusting themselves to the positions of locking combination and unlocking combination. The locking mechanism comprises a tube member capable of turning pivotally and making a translation motion. The tube member is characterized in that its first translation position serves to lock up the release end of the cable shackle when any one of numerical pieces is at a position of locking combination. On the other hand, when all numerical pieces are adjusted to the position of unlocking combination, the tube member is said to be at its second translation position for setting free the release end of the cable shackle. As soon as the tube member rotates for a predetermined angle from the second translation position, the tube member is then at the third translation position for facilitating numerical pieces to execute the operation of changing the unlocking combination.

DETAILED DESCRIPTION OF THE PREFERRED EMBODIMENT

Figure 1:
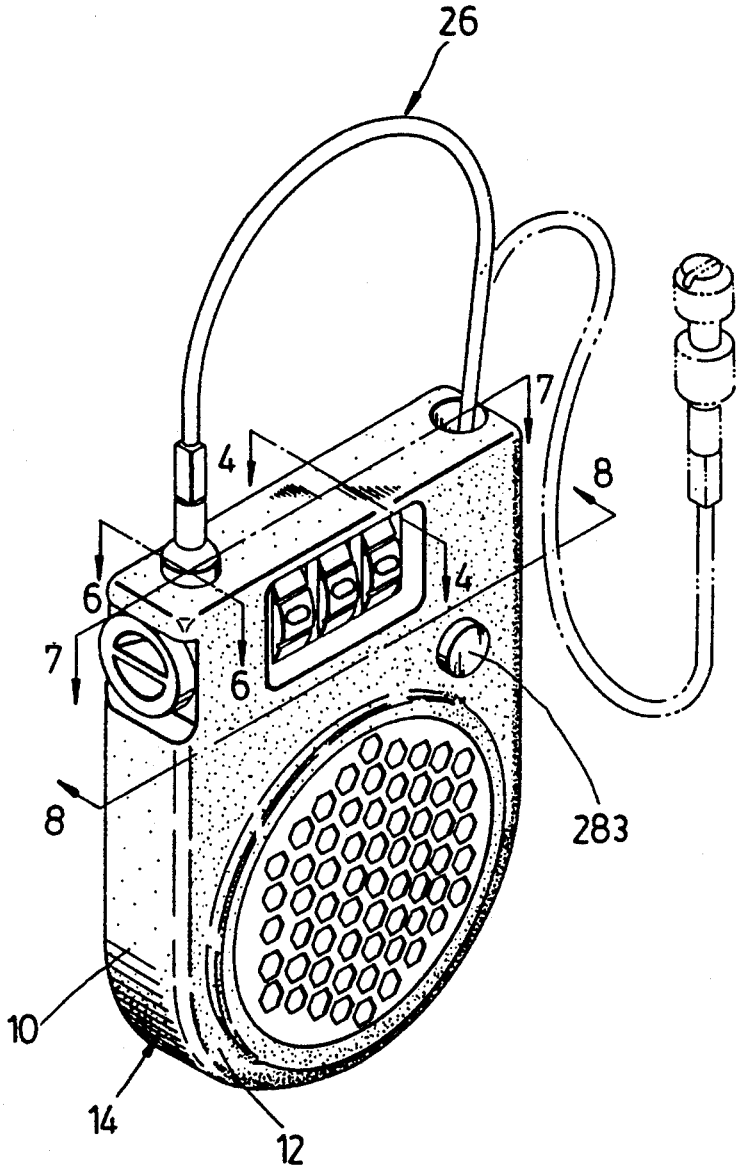
FIG. 1 shows a three-dimensional view of the preferred embodiment of the present invention.
Figure 2:
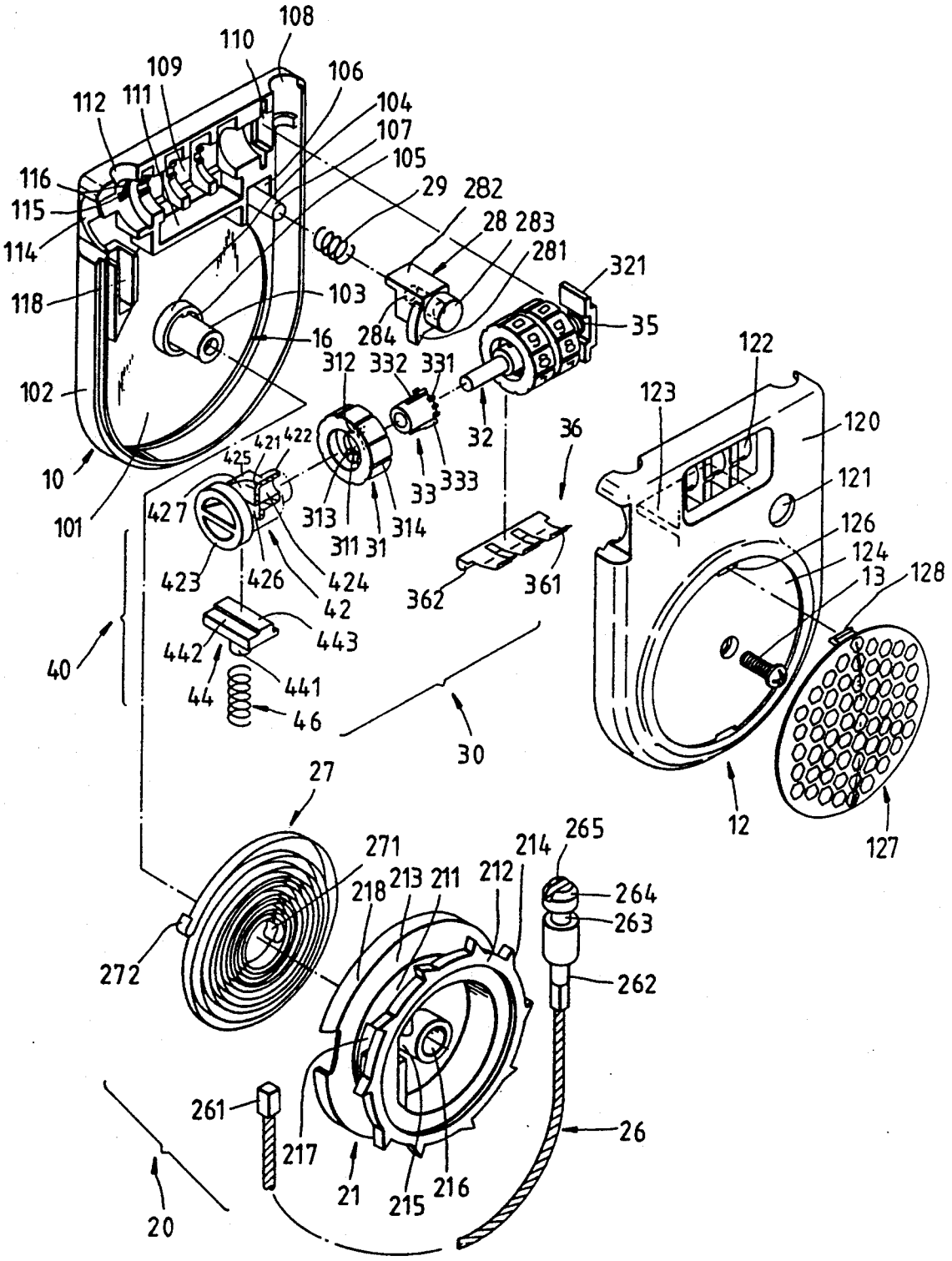
FIG. 2 shows an exploded view of the preferred embodiment of the present invention.
Figure 3:
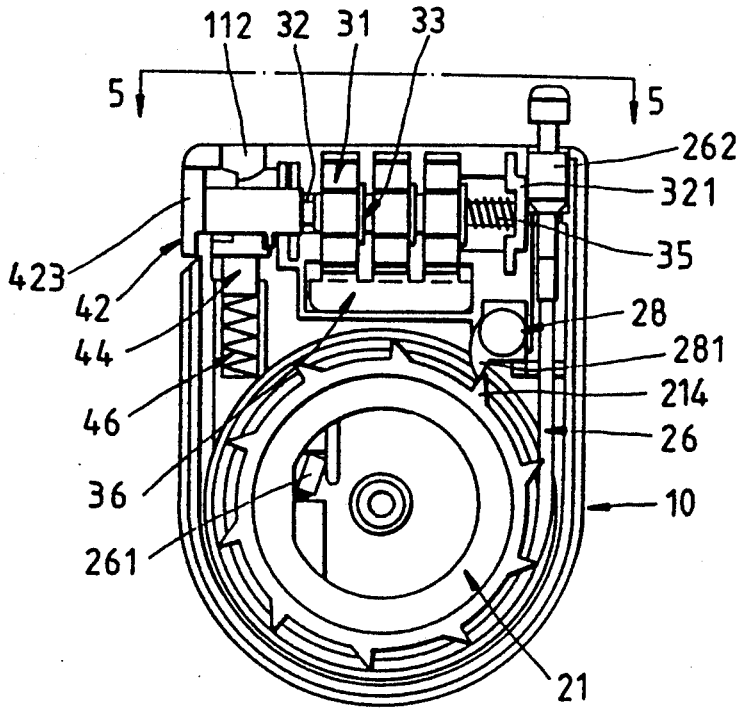
FIG. 3 is a top plane view showing portion of assembled parts of the preferred embodiment of the present invention.

Referring to FIGS. 1-3, the preferred embodiment of the present invention is shown comprising a base 10, a cover 12 which is corresponding in shape to the base 10 and closes the open face of the base 10, with a bolt 13 serving as a fastening means thereof, to form a housing 14. The base 10 comprises a base face 101, which is semicircular at lower portion thereof and is rectangular at upper portion thereof. The base face 101 has a side wall 102 extending upwardly and vertically from the rim thereof to form a receiving space 16. A cable shackle control mechanism 20 is lodged at the center of the receiving space 16. A combination assembly 30 is arranged at upper portion of the receiving space 16 while a locking mechanism 40 is disposed in the receiving space 16 at the position adjacent to the combination assembly 30.

Figure 5:
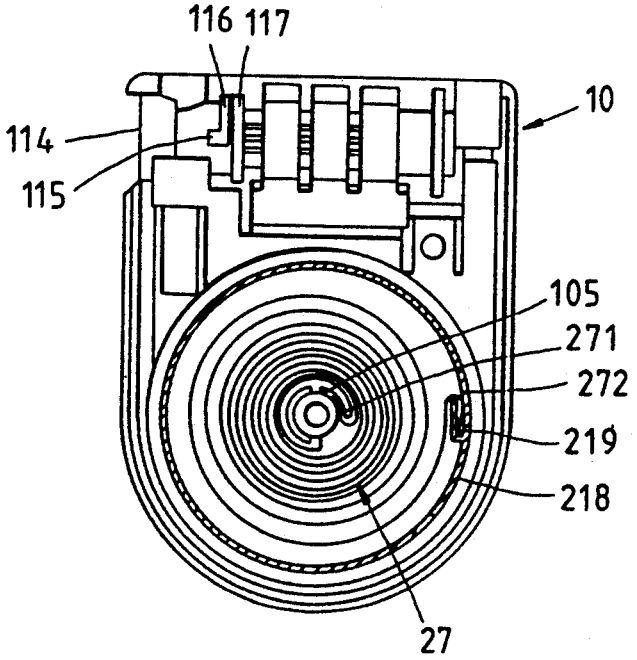
FIG. 5 shows a cut-away view of the portion taken along line 5—5, as shown in FIG. 3.

The cable shackle control mechanism 20 comprises a rotating wheel 21 with a wheel hub 211 disposed thereto. Located at both sides of the wheel hub 211 are respectively an upper wheel disk 212 and a lower wheel disk 213. The upper wheel disk 212 comprises a plurality of ratchet teeth 214 arranged at equal intervals along the rim thereof. A socket 215 is formed on the disk surface. The wheel hub 211 is composed of an axial hole 216 which is used to receive the axial shaft 103 pivotally arranged on the base face 101. The surface of wheel hub 211 comprises an open space 217 communicating with the socket 215. Located along the rim of the lower wheel disk 213 is a ring-shaped fold rim 218 extending outwardly to form a disklike space in conjunction with the disk surface of the lower wheel disk 213. The restrained end of the cable shackle 26 is attached to a rectangular block 261, which is inserted into the socket 215 via the open space 217. On the other hand, the open end of the cable shackle 26 is fastened to a plug pin 262 having a circular recess 263 and a cone-shaped top portion 264 disposed thereon. The cable shackle 26 is wound on the wheel hub 211. A volute spring 27 is accommodated in the disklike space mentioned above. The center end 271 of the volute spring 27 is inserted into the retaining groove 105 formed by a protruded ring 104 on the axial shaft 103 while the head end 272 is embedded in a recess 219 located at a predetermined position on the inner side of the fold rim 218, as shown in FIG. 5. As a result, when the cable shackle 26 is pulled, the rotating wheel 21 is thus actuated to turn to wind up the volute spring 27. As soon as the pulling force is removed from the cable shackle 26, the recoil of the volute spring 27 actuates the rotating wheel 21 to turn backward so as to bring about the rewinding of the cable shackle 26. The cable shackle control mechanism 20 comprises a pawl 28 with a hinged tongue 281. The base end 282 of the hinged tongue 281 extends upwardly to form a column portion 283, an opening located at the bottom side of the base end 282, and a column hole 284 extending inwardly. The base face 101 of the base 10 has a recess room 106 and a protruded column 107. The recess 106 is located at the upper right-hand corner of the position where the rotating wheel 21 is situated while the protruded column 107 extends upwardly from the bottom surface of the recess room 106. A coiled spring 29 encases the protruded column 107. The pawl 28 is mounted on the protruded column 107 by means of the column hole 284 in which the coiled spring 29 is compressed. The base end 282 is received in the recess room 106. As a result, when the cover 12 engages with the base 10, the column portion 283 is exposed via a circular hole 121 of the cover plate 120 of the cover 12. As long as the column portion 283 is not pressed, the hinged tongue 281 is caught and held by the ratchet tooth 214 of the rotating wheel 21, as shown in FIG. 3. As soon as the column portion 283 is pressed, the hinged tongue 281 becomes disengaged with the rotating wheel 21 so as to permit the cable shackle 26 to be pulled out or to rewind automatically. A guide exit 108 constructed along the side wall 102 is used to allow the open end of the cable shackle 26 to extend outwardly. The guide exit 108 is also used to receive the plug pin 262.

The combination assembly 30 is composed of three dial wheels 31 pivotally arranged on an axial rod 32. The sleeve 33 is lodged in the wheel hole 311 of the dial wheel 31. The sleeve 33 has small teeth 331 disposed thereon at one end thereof, a first rib 332 and three second ribs 333 arranged thereon at equal intervals. Each of three dial wheels 31 has a first flute 312 disposed on the wall of the wheel hole 311 at the position corresponding to that of the first rib 332. In addition, each of three dial wheels 31 has three second flutes 313 disposed on the wall of the wheel hole 311 at the positions corresponding to those of three second ribs 333. Therefore, when one of three dial wheels 31 is at the position of locking combination, the sleeve 33 is not able to move toward one side of the axial rod 32. On the other hand, when all dial wheels 31 are at the position of unlocking combination, the sleeve 33 are capable of moving simultaneously toward one side of the axial rod 32. The base 10 has three strip holes 109 arranged therein at equal intervals while the cover 12 comprises three strip holes 122 arranged therein at equal intervals. The strip hole is used to permit the portion of the wheel body of the dial wheel 31 to be exposed outwardly. The axial rod 32 has a rectangular base portion 321 disposed at one end thereof in the vicinity of the guide exit 108. The base portion 321 is lodged in an insertion slot 110 to position the axial rod 32 and the dial wheels 31. A coiled spring 35 encases the portion of the axial rod 32 located between the base portion 321 and the innermost sleeve 33 in order to exert a pressure on the small teeth 331 of the sleeve 33 to press tightly against the wheel hole 311 of the numerical wheel 31. In addition, the coiled spring 35 serves to force the sleeve 33 and the dial wheel 31 to move toward the open end of the axial rod 32. The combination assembly 30 further comprises an elastic brace piece 36, which is lodged in a rectangular recess room 111 located under the strip hole 109. The elastic brace piece 36 comprises three claw portions 361 and a fold plate portion 362. The tip of the claw portion 361 is used to engage with the elongated groove 314 located between two numerals marked on the dial wheel 31 in order to ensure that the numerical wheel 31 is rotated step by step. The fold plate portion 362 is lodged at the bottom of the recess room 111 and is pressed against by a long rib 123.

Figure 6:
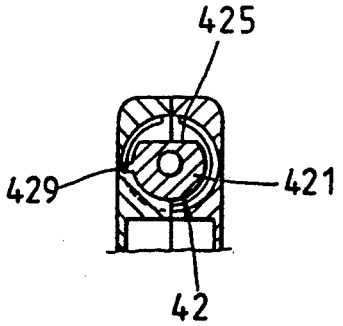
FIG. 6 shows a cut-away view of the portion taken along line 6—6, as shown in FIG. 1.
Figure 7:
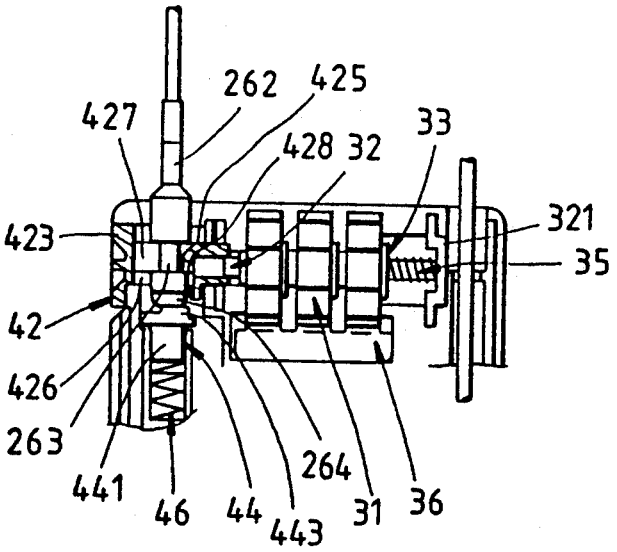
FIG. 7 is a cut-away view of the portion taken along line 7—7 of FIG. 1, showing that the tube member is at the first translation position.
Figure 8:
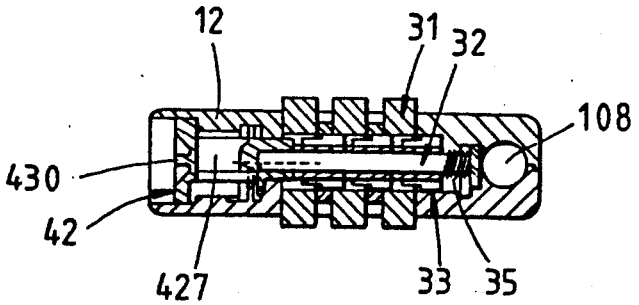
FIG. 8 is a cut-away view of the portion taken along line 8—8 of FIG. 1, showing that the tube member is at the third translation position.

The locking mechanism 40 comprises a tube member 42 which in turn is composed of a body portion 421 with protruded pillar 422 and annular cap portion 423 disposed thereon. The concavity 424 of the protruded pillar 422 is used to accommodate the open end of the axial rod 32. The body portion 421 includes a cutting plane 425, a recess room 426, an insertion hole 427 traversing the bottom of the recess room from the cutting plane 425 to form a shoulder portion 428, and a lug 429 disposed perpendicularly to the hole axis of the insertion hole 427 (see FIGS. 6 and 7). Under normal condition, the insertion hole 427 is in alignment with the entrance 112 located at the horizontal portion of the side wall 102 of the base 10, and the annular cap portion 423 is exposed to the outside via an annular hole 114 located at the vertical portion of the side wall 102 of the base 10 (see FIG. 5). The lug 429 is received in the retaining groove 115 which communicates with the starting end of the arc groove 116 (also see FIG. 5). An annular groove 117 is arranged in a manner that it communicates with the terminal end of the arc groove 116 (see FIG. 5). As a result, when one of the numerical wheels 31 is at the unlocking position, the tube member 42 is forced by the coiled spring 35 of the axial rod 32 to move to the first translation position. The plug pin 262 of the cable shackle 26 enters the insertion hole 427 of the tube member 42 via the entrance 112 while the portion of the hole surface of the insertion hole 427 enters the circular recess 263 of the plug pin 262 to force the shoulder portion 428 to make a close contact with the annular shoulder face located under the circular recess 263, as shown in FIG. 7. Therefore, the tube member 42 is capable of locking up the plug pin 262. In order to ensure that the plug pin 262 is effectively locked up, a sustaining piece 44 is arranged under the insertion hole 427 of the tube member 42. The sustaining piece 44 is composed of a column base 441, a rectangular plate portion 442 disposed at one end of the column base 441, and a sustaining portion 443 extending upwardly from the rectangular plate portion 442. The column base 441 is embedded in the receiving slot 118 of the base face 101. A coiled spring 46 is lodged in the space between the bottom wall of receiving slot 118 and the column base 441 so as to push the sustaining portion 443 of the sustaining piece 44 upward to exert a pressure on the top portion 264 of the plug pin 262. When all numerical wheels 31 are located at the unlocking position, the annular cap portion 423 of the tube member 42 is pressed to cause the lug 429 to make a translation movement to the arc groove 116 from the retaining groove 115. As a result, the tube member 42 moves to the second translation position, and the plug pin 262 is no longer restrained. When a change in the unlocking position of the numerical wheels is called for, it is necessary that the protruded rib 430 of the annular cap portion 423 of the tube member 42 is inserted into the cross flute 265 of the plug pin 262 and is subsequently pressed inwardly to force the lug 429 to position itself in the arc groove 116. The tube member 42 is still located at the second translation position. Rotating the tube member 42 for an angle of 90 degrees so that the lug 429 moves along the arc groove 116 to the end of the tube member 42, which is pressed inwardly again for a predetermined angle to force the lug 429 to move into the annular groove 117, results in the tube member 42 being at the third translation position, as shown in FIG. 8. Under this circumstance, the sleeve 33 and each of the dial wheels 31 have become disengaged so that a new set of unlocking combination of numerals can be re-established.

Figure 4:
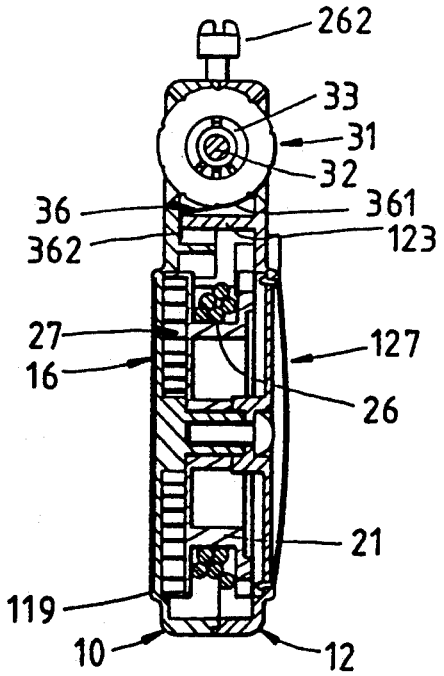
FIG. 4 shows a cut-away view of the portion taken along line 4—4, as shown in FIG. 1.
Figure 9:
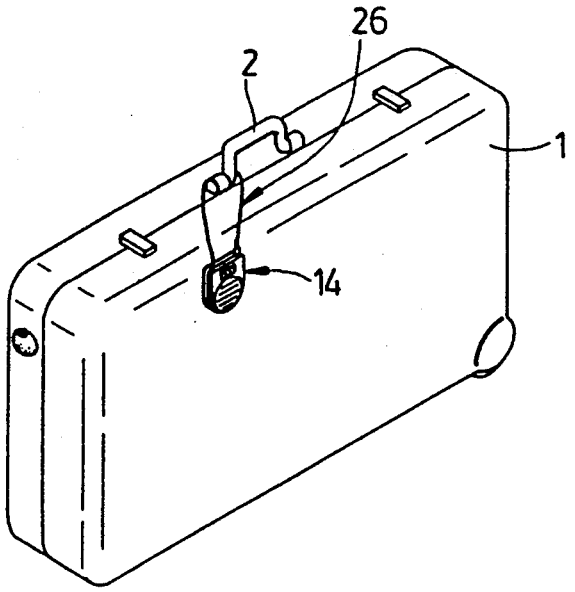
FIG. 9 shows a three-dimensional schematic view of the preferred embodiment of the present invention, which is used as an identification tag.
Figure 10:
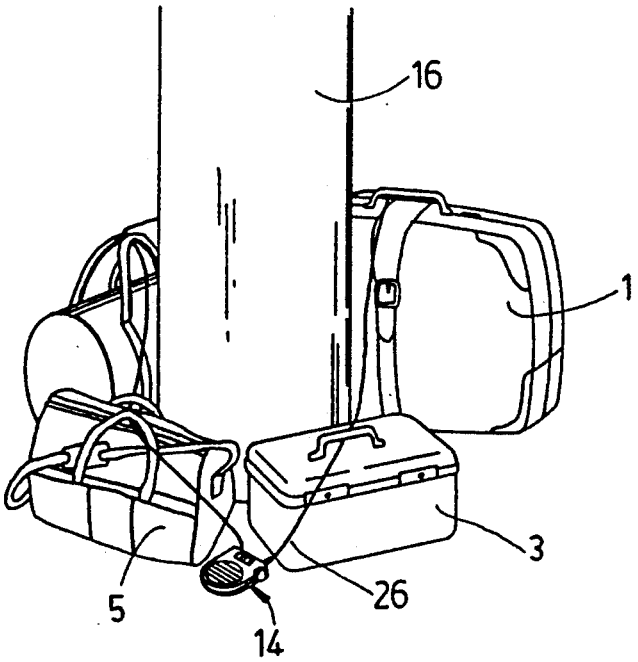
FIG. 10 shows a three-dimensional schematic view of the preferred embodiment of the present invention, which is used as a lock having a winding cable shackle disposed thereto.

The cover plate 120 of the cover 12 comprises a circular recess 124 disposed centrally at the outer side thereof. Located at the opposite positions on the circumference of the circular recess 124 are two inset holes 126. Similarly, two retaining lugs 128 are constructed at opposite positions on the circumference of a circular ornament plate 127 having thereon an arc-shaped surface. The retaining lugs 128 are designed in such a manner that they can be inserted into the inset holes 126 so as to hold the ornament plate 127 securely in the circular recess 124. Located on the outer side of the base face 101 of the base 10 is another circular recess 119 for use in placing an identification tag (see FIG. 4). The cable shackle 26 can be pulled out for an appropriate length to encircle the handle 2 of a suitcase 1, and subsequently the plug pin 262 is inserted into the entrance 112, in which the plug pin 262 is locked up by the tube member 42. As a result, the padlock embodied in the present invention can be used as an identification tag, as shown in FIG. 9. In addition, the cable shackle 26 can be pulled out to encircle individually a suit case 1, a vanity case 3, a hand bag 5, and a building pillar 16, and subsequently the plug pin 262 can be locked up by the tube member 42, as shown in FIG. 10.

What is claimed is:

1. A padlock having a cable shackle and a locking means based on combination of numerals comprising a cable shackle control mechanism, a locking mechanism, and a combination assembly; said cable shackle control mechanism comprising a rotating wheel, a cable shackle winding on said rotating wheel, a volute spring, and a pawl; said combination assembly being composed of a plurality of numerical pieces which include dial wheels rotatably and pivotally arranged side by side on an axial rod, each said dial wheel having a sleeve with a plurality of ribs disposed thereon, said ribs being positioned correspondingly to the flutes disposed in a wheel hole of said dial wheel, said numerical pieces further including a coiled spring lodged between one said sleeve and said axial rod; said axial rod, said dial wheel, said sleeve, said coil spring, said rotating wheel, said cable shackle, said volute spring, and said pawl being all arranged in a housing having a plurality of strip holes, a guide exit, an entrance, and an annular hole disposed therein, said dial wheel being exposed via said strip holes, said cable shackle having an open end extending outwardly via said guide exit and entering said housing via said entrance, said housing comprising a retaining groove communicating with a starting end of an arc groove, and an annular groove communicating with a terminating end of said arc groove; said locking mechanism including a tube member, which is characterized in that it comprises a body portion, a protruded pillar extending outwardly from the lower end of said body portion, and an annular cap portion located at an upper end of said body portion having an insertion hole disposed therein, said protruded pillar having a concavity disposed thereon, said body portion further comprising at the bottom thereof a lug arranged perpendicularly to the hole axis of said insertion hole, said tube member being at a first translation position when said lug is located in said retaining groove, said tube member being at a second translation position when said lug has moved to said arc groove from said retaining groove, and said tube member being at a third translation position when said lug has moved to said annular groove from said arc groove.

2. A padlock having a cable shackle and a locking means based on combination of numerals in accordance with claim 1, wherein said locking mechanism comprises a sustaining piece located under said insertion hole of said tube member, said sustaining piece comprising a rectangular base portion and a column portion extending upwardly from the bottom of said rectangular base portion, said column portion being received in a receiving slot of said housing, said receiving slot having a wall in contact with one end of a coiled spring whose other end urges against said column portion of said sustaining piece.

3. A padlock having a cable shackle and a locking means based on combination of numerals in accordance with claim 1, wherein said pawl comprises a hinged tongue having a base end extending upwardly to form said column portion, and wherein said pawl is mounted on a protruded column.

* * * * *